US010169939B2

(12) United States Patent
He et al.

(10) Patent No.: US 10,169,939 B2
(45) Date of Patent: Jan. 1, 2019

(54) IDENTITY RECOGNITION

(71) Applicant: International Business Machines Corporation, Armonk, NY (US)

(72) Inventors: Jun He, Beijing (CN); ZhiWei Wang, Beijing (CN); Li Xu, Beijing (CN); Li Zhang, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 171 days.

(21) Appl. No.: 15/071,458

(22) Filed: Mar. 16, 2016

(65) Prior Publication Data

US 2017/0270723 A1 Sep. 21, 2017

(51) Int. Cl.
*G07C 9/00* (2006.01)

(52) U.S. Cl.
CPC ..... *G07C 9/00119* (2013.01); *G07C 9/00031* (2013.01); *G07C 9/00103* (2013.01); *G07C 9/00174* (2013.01); *G07C 2009/00412* (2013.01); *G07C 2009/00769* (2013.01); *G07C 2209/08* (2013.01)

(58) Field of Classification Search
CPC ..... G07C 9/00119; G07C 9/00031; G07C 2009/00769; G07C 2009/00412; G08B 29/18; G08B 25/008
See application file for complete search history.

(56) References Cited

U.S. PATENT DOCUMENTS 7,852,196 B1 * 12/2010 Adams ..... G06F 21/33 340/5.2
8,744,523 B2 6/2014 Fan et al.
8,787,886 B2 7/2014 Jonsson
9,300,646 B1 * 3/2016 Saylor ..... H04L 63/08
9,640,002 B1 * 5/2017 Grosberg ..... G07C 9/00174
2002/0103765 A1 * 8/2002 Ohmori ..... G06Q 20/02 705/67

(Continued)

FOREIGN PATENT DOCUMENTS

CN 104038742 A 9/2014
CN 204242263 U 4/2015

OTHER PUBLICATIONS

Kim et al., "Integration of Face Recognition and Sound Localization for a Smart Door Phone System", 2013 IEEE International Conference on Consumer Electronics (ICCE), © 2013 IEEE, p. 320-321.

(Continued)

*Primary Examiner* — Nabil H Syed
(74) *Attorney, Agent, or Firm* — Brian M. Restauro

(57) ABSTRACT

Embodiments of the present invention provide methods, computer program products, and systems to automatically verify a person's claimed identity using wireless token passing. Embodiments of the present invention can be used to receive identification data comprising a universally unique identifier (UUID) and a first security token and process the received identification data by matching the UUID to an associated website and verifying the first security token against a second security token. Embodiments of the present invention can be used to notify a first user of the processed identification data by displaying an indication that verification of the identification data was successful or unsuccessful.

17 Claims, 5 Drawing Sheets

(56) References Cited

U.S. PATENT DOCUMENTS

| | | | | |
|---|---|---|---|---|
| 2003/0146852 | A1* | 8/2003 | O'Dell | G07B 15/02 340/932.2 |
| 2004/0243812 | A1* | 12/2004 | Yui | G07C 1/10 713/182 |
| 2008/0198006 | A1 | 8/2008 | Chou | |
| 2012/0044049 | A1 | 2/2012 | Vig et al. | |
| 2012/0044050 | A1 | 2/2012 | Vig et al. | |

OTHER PUBLICATIONS

Sahani et al., "Web-Based Online Embedded Door Access Control and Home Security System Based on Face Recognition", 2015 International Conference on Circuit, Power and Computing Technologies [ICCPCT], © 2015 IEEE, 6 pages.

* cited by examiner

IDENTITY RECOGNITION

BACKGROUND

This invention relates generally to the field of identity recognition, and more particularly, to identity recognition using wireless token passing.

Typically, a security token is a type of authentication security device that may be used to authorize computer services. A security token can be stored on an electronic device such as a mobile phone. In a shared secret architecture, an administrator typically generates a configuration file for each end-user which comprises a username, a personal identification number, and a password.

SUMMARY

Embodiments of the present invention provide methods, computer program products, and systems to automatically verify a person's claimed identity using wireless token passing. In one embodiment of the present invention, a computer-implemented method is provided comprising: receiving identification data comprising a universally unique identifier (UUID) and a first security token; processing the received identification data, by matching the UUID to an associated website and verifying the first security token against a second security token; and notifying a first user of the processed identification data, by displaying an indication that verification of the identification data was successful or unsuccessful.

DETAILED DESCRIPTION

Embodiments of the present invention recognize inefficiencies with home security systems. For example, inhabitants of a home may not be able to readily confirm a person's claimed identity (e.g., a repairman, a cable technician, etc.). In some instances, credentials, such as ID badges can be faked or duplicated. Embodiments of the present invention provide solutions to automatically verify a person's claimed identity using wireless token passing. In this manner, as discussed in greater detail in this specification, embodiments of the present invention can be used to disarm security system responsive to verifying a person's claimed identity using wireless token passing.

Figure 1:
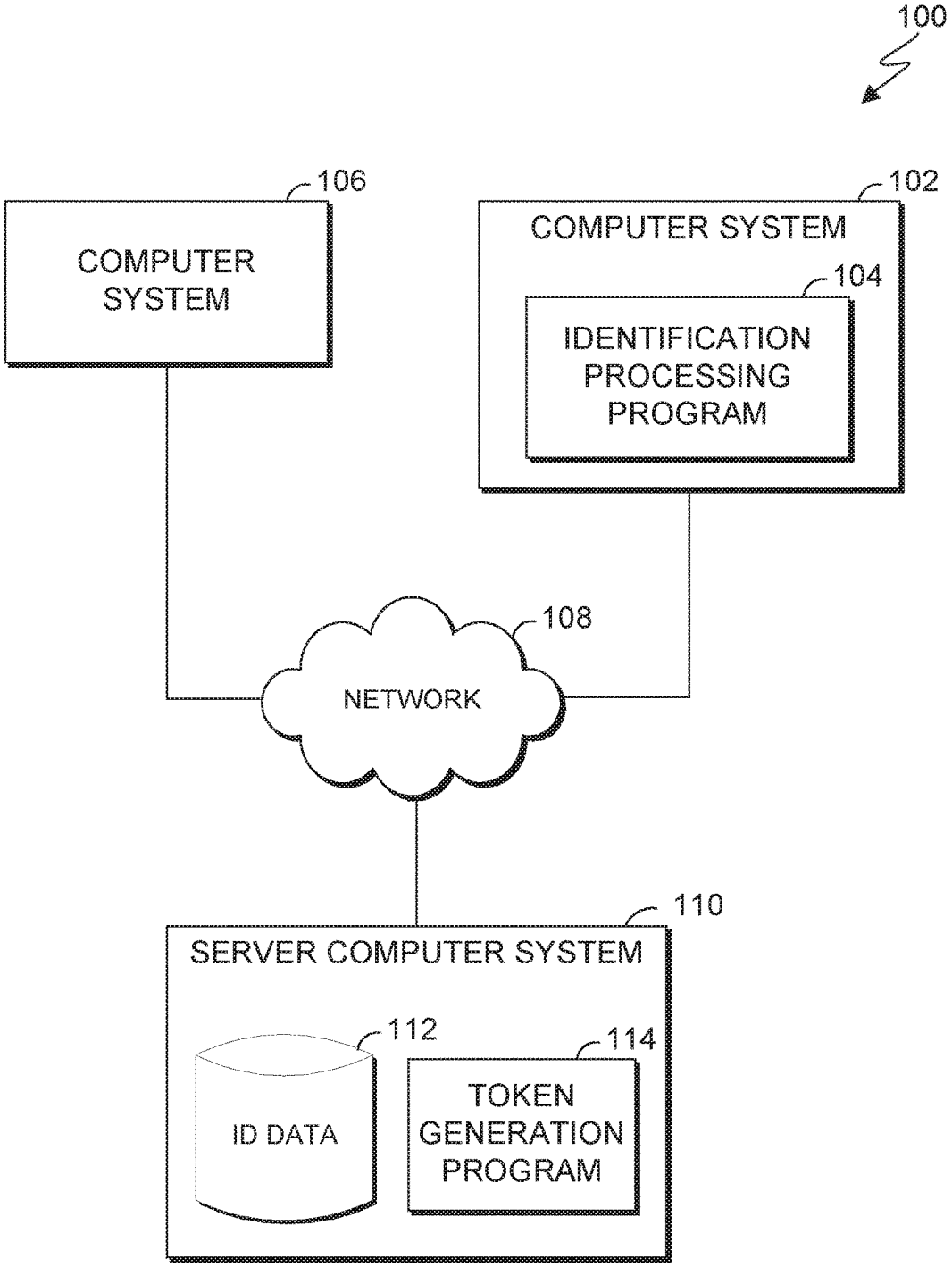
FIG. 1 is a functional block diagram illustrating a computing environment, in accordance with an embodiment of the present invention.

FIG. 1 is a functional block diagram of computing environment 100, in accordance with an embodiment of the present invention. Computing environment system 100 includes computer system 102, computer system 106, and server computer system 110. Computer system 102, computer system 106, and server computer system 110 can be desktop computers, laptop computers, specialized computer servers, or any other computer systems known in the art. In certain embodiments, computer system 102, computer system 106, and server computer system 110 represent computer systems utilizing clustered computers and components to act as a single pool of seamless resources when accessed through network 108. For example, such embodiments may be used in data center, cloud computing, storage area network (SAN), and network attached storage (NAS) applications. In certain embodiments, computer system 102, computer system 106, and server computer system 110 represent virtual machines. In general, computer system 102, computer system 106, and server computer system 110 are representative of any electronic devices, or combination of electronic devices, capable of executing machine-readable program instructions, as described in greater detail with regard to FIG. 5.

Computer system 102 includes identification processing program 104. Identification processing program 104 receives one or more inputs from computer system 106 and verifies a claimed identity by interacting with server computer system 110, as discussed in greater detail with regard to FIGS. 2 and 3. For example, responsive to receiving a verification request from computer system 106 (e.g., a verification request from a technician's cell phone), identification processing program 104 can confirm the identity of the technician and alert a user to disarm the user's home security system to grant access to the technician. In some embodiments, identification processing program 104 can interact with a security system (not shown) remotely (i.e., without the user's presence and/or input) to disarm alarms and grant access to a person having a verified identity and, responsive to detecting that the authorized person is no longer on the premises can re-arm the security system.

Computer system 106 can be any electronic device associated with a person attempting to gain access to premises (e.g., a technician, electrician, etc.). Computer system 106 is associated with a respective universally unique identifier (UUID) as a way to distinguish one company from another and can be used to request a security token from server computer system 110, and subsequently transmit a verification request to identification processing program 104 (via network 108). In this embodiment, a verification request includes a UUID and a security token. In this embodiment, a UUID is associated with one or more companies having employees delivering goods and/or services to a customer's residence.

A "security token" as used herein, refers to a configuration file associated with an employee of the company and comprises a username, a personal identification number and a passcode and/or passphrase to distinguish one employee from another. In this embodiment, the security token is a one-off token generated in response to a request from an employee. In other embodiments, the security token may be generated in response to a scheduled appointment. For example, the security token may be generated when an employee (e.g., a plumber) is assigned to an appointment time, for example, to fix a customer's leaky pipes). In other embodiments, a security token may also display an employee's fingerprints and/or photo along with the employee's stated purpose for the visit (e.g., a plumber whose stated purpose is to fix a leaky pipe).

The security token may also include instructions for a specified amount of authorized time to be on the premises. For example, the security token may specify that an employee (e.g., a plumber) has security clearance to be on-site for three hours. In instances where the authorized time nears expiration, identification processing program 104 can transmit a notification to the user of computer system 102 and request an extension or confirm revocation of authorization at the end of the authorized time period.

In instances where identification processing program 104 interacts with a security system to remotely grant access to the premises (e.g., a home) while the owner of the premises is not there, identification processing program 104 can monitor the specified amount of authorized time to be on the premises, detect whether the authorized person (e.g., a technician) has finished the job, and responsive to confirming that the authorized person has finished the job and left the premises, re-enable the security system. In this embodiment, identification processing program 104 confirms whether the authorized person has finished the job responsive to receiving an indication of completion from the authorized person (e.g., via a transmission of a device associated with the technician). Accordingly, identification processing program 104 can re-enable the security system and transmit a notification and/or request to the homeowner for confirmation.

The security token may further include another specified amount of time for which the security token is valid. For example, the security token may specify a time period of thirty minutes before the security token expires, that is, that the security token has thirty minutes in which to be verified against sever computer system 110. In instances where the specified time period for which the security token is valid expires, a new security token must be issued. In other words, a new security token must be generated by token generation program 114, transmitted to the user of computer system 106, and subsequently transmitted to identification processing program 104 for verification.

Server computer system 110 serves as a verification system that issues tokens to devices (e.g., computer system 106) of users (e.g., employees of a plumber service) via network 108 (e.g., using TCP/IP) and stores employee data (e.g., employee names, pictures, job title, purpose for on-site visit, etc.). Server computer system 110 includes token generation program 114 and ID data 112.

Token generation program 114 generates a security token for employees of each respective associated company in response to a request from an employee of the associated company. For example, an employee using computer system 106 (e.g., a cell phone) can be scheduled to do repairs of customer A's residence. The employee can use computer system 106 can transmit a request for a security token to server computer system 110 (e.g., TCP/IP). Responsive to receiving the request for the security token, token generation program 114 can generate and transmit the security token to computer system 106. Computer system 106 can then transmit the received security token and UUID to identification processing program 104 for verification.

In this embodiment, token generation program 114 generates a new security token for respective employees that is valid for a pre-configured amount of time. For example, an employee can request a new security token prior to a scheduled maintenance appointment at a customer's residence. Responsive to receiving a request for a security token, token generation program 114 can generate a security token for the employee that is valid for the duration of the appointment. For subsequent appointments, the employee can request another security token to present to customers for verification.

ID data 112 stores identification data associated with users. In this embodiment, ID data 112 stores security tokens associated with employees of respective companies generated by token generation program 114. ID data 112 can be accessed by identification processing program 104 to match a UUID to a respective company and subsequently verify the received security token with the security token stored in ID data 112. For example, identification processing program 104 can receive a UUID and match the UUID to an associated uniform resource locator (URL) associated with the UUID. For example, identification processing program 104 can match a UUID to a company's website (e.g., UUID corresponds to website A) and confirm that the received security token matches the security stored in ID data 112.

In other embodiments, ID data 112 can store UUIDs and security tokens for any number of groups and individuals. For example, ID data 112 can store security tokens for individual family members and/or friends. In general, ID data 112 can be implemented using any non-volatile storage media known in the art. For example, ID data 112 can be implemented with a tape library, optical library, one or more independent hard disk drives, or multiple hard disk drives in a redundant array of independent disks (RAID).

In other embodiments, token generation program 114, ID data 112 and identification processing program 104 can be used in social networking services. For example, user alpha and user beta both use a social networking services to meet new people and the social networking service has matched user alpha and user beta. User beta is scheduled to meet user alpha at user alpha's residence. User beta, using computer system 106 (e.g., a cell phone) can connect to the social networking service's system (e.g., server computer system 110) and request a security token. Responsive to receiving the request for the security token, token generation program 114 can generate and transmit the security token to computer system 106. Computer system 106 can then transmit the received security token and UUID to identification processing program 104 for verification.

Network 108 can be, for example, a local area network (LAN), a wide area network (WAN) such as the Internet, or a combination of the two, and include wired, wireless, or fiber optic connections. In general, network 108 can be any combination of connections and protocols that will support communications between computer system 102, computer system 106, and server computer system 110, in accordance with a desired embodiment of the invention.

It should be understood that, for illustrative purposes, FIG. 1 does not show other computer systems and elements which may be present when implementing embodiments of the present invention. For example, while FIG. 1 shows a single computer system 106 associated with a person whose credentials needs to be verified, a single computer system 102 associated with a user of identification processing program 104, and a single server computer system 110 in computing environment 100 can also include additional computer systems (e.g., multiple server computer systems 110 for each respective company).

Figure 2:
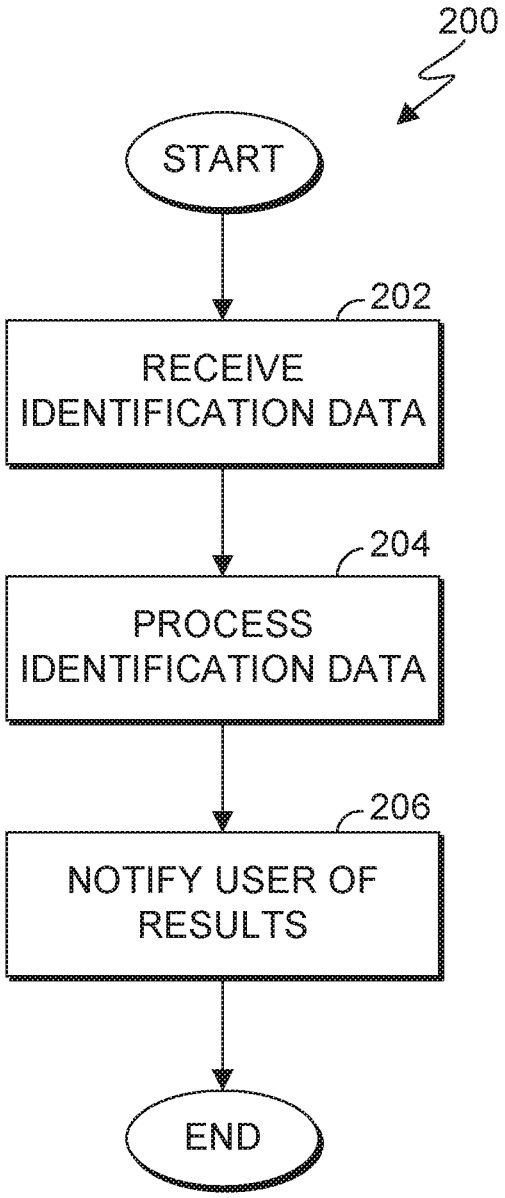
FIG. 2 is a flowchart illustrating operational steps of processing identification data, in accordance with an embodiment of the present invention.

FIG. 2 is a flowchart 200 illustrating operational steps of processing identification data, in accordance with an embodiment of the present invention.

In step 202, identification processing program 104 receives identification data. In this embodiment, identification processing program 104 can receive identification data from computer system 106. As mentioned earlier, in this embodiment, identification data comprises a UUID and a security token associated with a user of computer system 106. In other embodiments, identification processing program 104 can receive identification data from one or more other components of computing environment 100.

In step 204, identification processing program 104 processes the identification data. In this embodiment identification processing program 104 processes the identification data by matching the received UUID to a URL associated with a respective company, connecting to the respective company's server, and verifying the received security token, as discussed in greater detail with regard to FIGS. 3 and 4.

In step 206, identification processing program 104 notifies a user of the results. In this embodiment, identification processing program 104 notifies the user of the results by displaying the results of the processed identification data. Continuing the above example, identification processing program 104 can display that the identification of the person claiming to be the plumber sent by company X to repair the leaky faucet has been verified. Alternatively, identification processing program 104 can display that the identification of the person claiming to be the plumber has failed.

In other embodiments, identification processing program 104 can interact with a home security system to arm and disarm based, at least in part on a positive identification. For example, responsive to verifying that the person presenting identification data (e.g., UUID and security token) belongs to a resident of the household, identification processing program 104 can disarm the home security system and grant access to the person.

Figure 3:
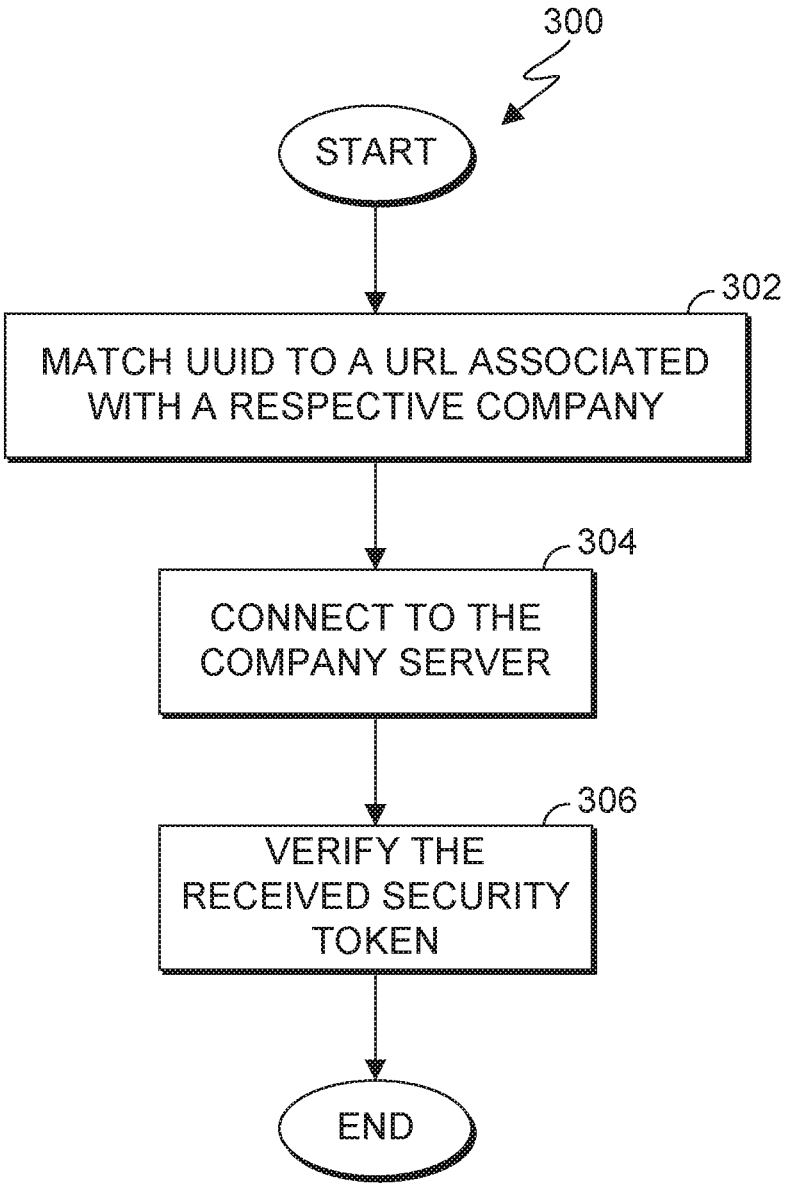
FIG. 3 is a flowchart illustrating operational steps for verifying security tokens, in accordance with an embodiment of the present invention.

FIG. 3 is a flowchart illustrating operational steps for verifying security tokens, in accordance with an embodiment of the present invention. For example, the operational steps of flowchart 300 can be performed at step 204 of flowchart 200.

In step 302, identification processing program 104 matches the received UUID to a URL associated with a respective company. For example, identification processing program 104 can receive the following UUID: f7826da6-4fa2-4e98-8024-bc5b71e0893e. Identification processing program 104 can then match the received UUID to an associated company URL. For example, identification processing program 104 can match f7826da6-4fa2-4e98-8024-bc5b71e0893e to www.bestplumberintown.com.

In step 304, identification processing program 104 connects to the company's server. In this embodiment, identification processing program 104 connects to the company's server by accessing the URL associated with the UUID and retrieving the website's certificate. Identification processing program 104 can validate the website's certificate against certificate authority root certificates previously stored on computer system 102.

In step 306, identification processing program 104 verifies the received security token. In this embodiment, identification processing program 104 verifies the received security token by transmitting the received security token to the company's server (e.g., server computer system 110) and matching the received security token to the security token stored in ID data 112. For example, identification processing program 104 could receive the following security token: 684314. Identification processing program 104 can transmit the received security token to server computer system 110 and match the received security token to the token generated by server computer system 110.

Figure 4:
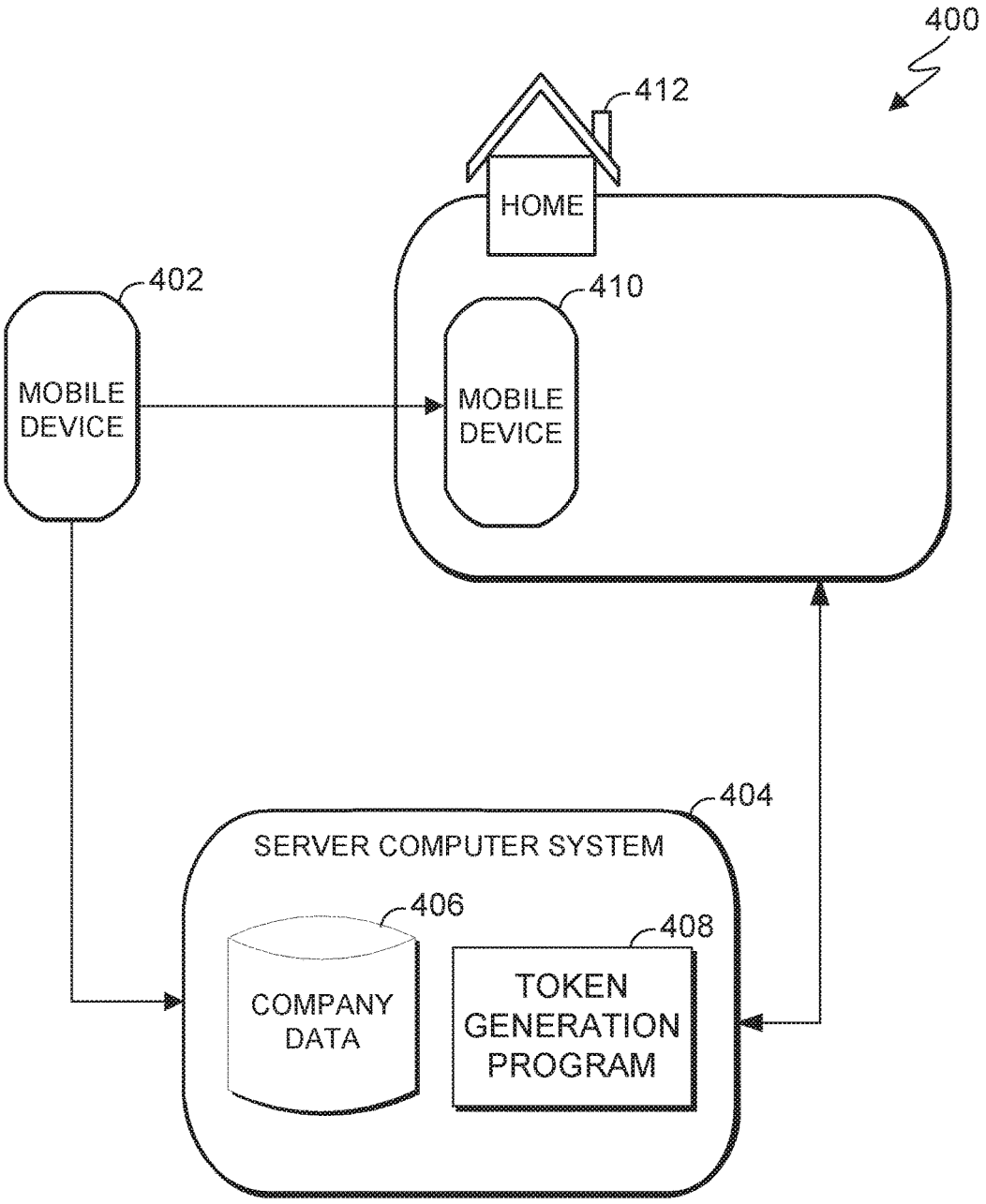
FIG. 4 is a block diagram that is helpful in understanding the processing of identification data, in accordance with an embodiment of the present invention.

FIG. 4 is a block diagram 400 that is helpful in understanding the processing of identification data, in accordance with an embodiment of the present invention.

In this example, a technician $T_A$ of $Company_1$ has scheduled to perform repairs to fix faulty internet connection at user alpha's residence at 10:00 am. $Company_1$ has a UUID of 1db02d5f-743b-4e7e-8f83-4d9338df64b7 which is associated with a website owned by $Company_1$ (e.g., www.company1.com).

Upon arriving at user alpha's home (e.g., home 412), technician $T_A$ can use mobile device 402 to log in to the company's computer systems (e.g., server computer system 404) to request a security token from token generation program 408. Responsive to receiving a request for a security token, token generation program 408 can generate a one-time security token for technician $T_A$ that technician $T_A$ can use to identify himself to user alpha. In this example, the security token is an alphanumeric sequence and a specified amount of time that the security token is valid. In other embodiments, the security token may contain the technician's name, the technician's employee serial number, and a passphrase that will be used to verify the technician's identity.

Technician $T_A$ can then broadcast the identification data (e.g., the UUID and security token) to a device (e.g., mobile device 410) that user alpha is using. User alpha can then access identification processing program (not shown) to verify technician $T_A$'s identity.

In this example, the identification processing program (e.g., identification processing program 104) matches the received UUID to the website associated with $Company_1$. Identification processing program 104 can then access the website associated with $Company_1$ (e.g., www.company1.com), retrieve the website's security certificates, and validate the website is trusted by a respective certificate authority previously installed on user alpha's device (e.g., mobile device 410).

Accordingly, identification processing program 104 can then transmit the security token received from technician $T_A$ to server computer system 404 to verify technician $T_A$'s identity by matching the received security token to the security token generated by token generation program 408, that is, that the alphanumeric sequences match. Responsive to determining that the alphanumeric sequences match, identification processing program 104 verifies that technician $T_A$ is in fact the technician scheduled to repair user alpha's internet connection by matching the security token provided to it to the security token stored in company data 406. Accordingly, the identification processing program alerts user alpha that technician $T_A$ is who he claims to be. User alpha can then deactivate user alpha's home security system to grant technician $T_A$ access to user alpha's home (e.g., home 412).

Figure 5:
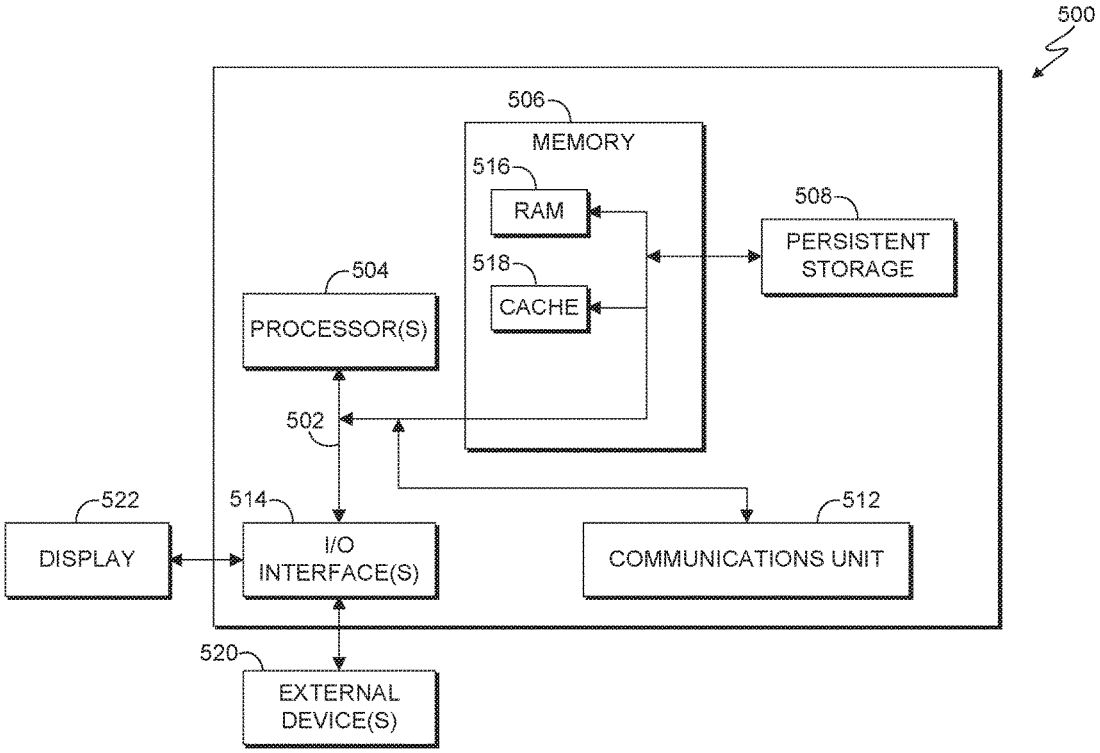
FIG. 5 is a block diagram of internal and external components of the computer systems of FIG. 1, in accordance with an embodiment of the present invention.

FIG. 5 is a block diagram of internal and external components of a computer system 500, which is representative the computer systems of FIG. 1, in accordance with an embodiment of the present invention. It should be appreciated that FIG. 5 provides only an illustration of one implementation and does not imply any limitations with regard to the environments in which different embodiments may be implemented. In general, the components illustrated in FIG. 5 are representative of any electronic device capable of executing machine-readable program instructions. Examples of computer systems, environments, and/or configurations that may be represented by the components illustrated in FIG. 5 include, but are not limited to, personal computer systems, server computer systems, thin clients, thick clients, laptop computer systems, tablet computer systems, cellular telephones (e.g., smart phones), multiprocessor systems, microprocessor-based systems, network PCs, minicomputer systems, mainframe computer systems, and distributed cloud computing environments that include any of the above systems or devices.

Computer system 500 includes communications fabric 502, which provides for communications between one or more processors 504, memory 506, persistent storage 508, communications unit 512, and one or more input/output (I/O) interfaces 514. Communications fabric 502 can be implemented with any architecture designed for passing data and/or control information between processors (such as microprocessors, communications and network processors, etc.), system memory, peripheral devices, and any other hardware components within a system. For example, communications fabric 502 can be implemented with one or more buses.

Memory 506 and persistent storage 508 are computer-readable storage media. In this embodiment, memory 506 includes random access memory (RAM) 516 and cache memory 518. In general, memory 506 can include any suitable volatile or non-volatile computer-readable storage media. Software is stored in persistent storage 508 for execution and/or access by one or more of the respective processors 504 via one or more memories of memory 506.

Persistent storage 508 may include, for example, a plurality of magnetic hard disk drives. Alternatively, or in addition to magnetic hard disk drives, persistent storage 508 can include one or more solid state hard drives, semiconductor storage devices, read-only memories (ROM), erasable programmable read-only memories (EPROM), flash memories, or any other computer-readable storage media that is capable of storing program instructions or digital information.

The media used by persistent storage 508 can also be removable. For example, a removable hard drive can be used for persistent storage 508. Other examples include optical and magnetic disks, thumb drives, and smart cards that are inserted into a drive for transfer onto another computer-readable storage medium that is also part of persistent storage 508.

Communications unit 512 provides for communications with other computer systems or devices via a network (e.g., network 108). In this exemplary embodiment, communications unit 512 includes network adapters or interfaces such as a TCP/IP adapter cards, wireless Wi-Fi interface cards, or 3G or 4G wireless interface cards or other wired or wireless communication links. The network can comprise, for example, copper wires, optical fibers, wireless transmission, routers, firewalls, switches, gateway computers and/or edge servers. Software and data used to practice embodiments of the present invention can be downloaded to computer system 102 through communications unit 512 (e.g., via the Internet, a local area network or other wide area network). From communications unit 512, the software and data can be loaded onto persistent storage 508.

One or more I/O interfaces 514 allow for input and output of data with other devices that may be connected to computer system 500. For example, I/O interface 514 can provide a connection to one or more external devices 520 such as a keyboard, computer mouse, touch screen, virtual keyboard, touch pad, pointing device, or other human interface devices. External devices 520 can also include portable computer-readable storage media such as, for example, thumb drives, portable optical or magnetic disks, and memory cards. I/O interface 514 also connects to display 522.

Display 522 provides a mechanism to display data to a user and can be, for example, a computer monitor. Display 522 can also be an incorporated display and may function as a touch screen, such as a built-in display of a tablet computer.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A computer-implemented method comprising:

receiving, by a user device of a first user, identification data comprising a universally unique identifier (UUID) that is associated with a security database of a second user and a first security token associated with the second user;

verifying, by the user device, the received identification data by utilizing the UUID to access the security database that purportedly issued the UUID and verifying that the first security token matches a second security token generated by the security database;

responsive to verifying the received identification data, disarming a security system associated with the user device for a specified time period;

detecting the presence or absence of the second user;

confirming whether the second user has completed a task associated with the first security token; and responsive to detecting the absence of the second user and confirming whether the second user has completed the task, automatically re-arming the security system associated with the user device after the specified time period expires.

2. The computer-implemented method of claim 1, wherein the first security token is used to authenticate access for the second user to premises associated with the first user.

3. The computer-implemented method of claim 2, wherein the first security token comprises: an alphanumeric sequence, an amount of time that the first security token is valid, an amount of authorized time to be on premises, and a stated purpose for access.

4. The computer-implemented method of claim 1, further comprising:

responsive to detecting that the authorized time to be on premises is expiring, transmitting a first notification to the first user that the authorized time is expiring and a request to either extend the authorized time to be on premises or confirm revocation of authorization at the expiration of the authorized time period.

5. The computer-implemented method of claim 4, further comprising:

responsive to receiving the confirmation to revoke authorization at the expiration of the authorized time period, confirming that the stated purpose has been completed; and responsive to confirming that the stated purpose has been completed, re-enabling the first user's security system.

6. The computer implemented method of claim 5, wherein confirming that the stated purpose has been completed comprises:

receiving an indication that the stated purpose has been completed and an indication that the second user associated with the security token is no longer on premises.

7. The computer-implemented method of claim 4, further comprising:

responsive to receiving the extension of authorized time, extending the authorized time;

transmitting a second notification to the user that the authorized time is expiring and a request to either extend the authorized time to be on premises or confirm revocation of authorization at the expiration of the authorized time period;

responsive to receiving the confirmation to revoke authorization at the expiration of the authorized time period, confirming that the stated purpose has been completed; and responsive to confirming that the stated purpose has been completed, re-enabling the first user's security system.

8. A computer program product comprising:

one or more computer readable storage media and program instructions stored on the one or more computer readable storage media, the program instructions comprising:

program instructions to receive, by a user device of a first user, identification data comprising a universally unique identifier (UUID) that is associated with a security database of a second user and a first security token associated with the second user;

program instructions to verify, by the user device, the received identification data by utilizing the UUID to access the security database that purportedly issued the UUID and verifying that the first security token matches a second security token generated by the security database;

responsive to verifying the received identification data, disarming a security system associated with the user device for a specified time period;

program instructions to, responsive to verifying the received identification data, disarm a security system associated with the user device for a specified time period;

program instructions to detect the presence or absence of the second user;

program instructions to confirm whether the second user has completed a task associated with the first security token; and program instructions to, responsive to detecting the absence of the second user and confirming whether the second user has completed the task, automatically re-arm the security system associated with the user device after the specified time period expires.

9. The computer program product of claim 8, wherein the first security token is used to authenticate access for the second user to premises associated with the first user.

10. The computer program product of claim 9, wherein the first security token comprises: an alphanumeric sequence, an amount of time that the first security token is valid, an amount of authorized time to be on premises, and a stated purpose for access.

11. The computer program product of claim 8, wherein the program instructions stored on the one or more computer readable storage media further comprise:

program instructions to, responsive to detecting that the authorized time to be on premises is expiring, transmit a first notification to the first user that the authorized time is expiring and a request to either extend the authorized time to be on premises or confirm revocation of authorization at the expiration of the authorized time period.

12. The computer program product of claim 11, wherein the program instructions stored on the one or more computer readable storage media further comprise:

program instructions to, responsive to receiving the confirmation to revoke authorization at the expiration of the authorized time period confirm that the stated purpose has been completed; and program instructions to, responsive to confirming that the stated purpose has been completed, re-enable the first user's security system.

13. The computer program product of claim 12, wherein the program instructions to confirm that the stated purpose has been completed comprise:

program instructions to receive an indication that the stated purpose has been completed and an indication that the second user associated with the security token is no longer on premises.

14. The computer program product of claim 11, wherein the program instructions stored on the one or more computer readable storage media further comprise:

program instructions to responsive to receiving the extension of authorized time, extending the authorized time;

program instructions to transmit a second notification to the user that the authorized time is expiring and a request to either extend the authorized time to be on premises or confirm revocation of authorization at the expiration of the authorized time period;

program instructions to, responsive to receiving the confirmation to revoke authorization at the expiration of the authorized time period, confirm that the stated purpose has been completed; and program instructions to, responsive to confirming that the stated purpose has been completed, re-enable the first user's security system.

15. A computer system comprising:

one or more computer processors;

one or more computer readable storage media; and program instructions stored on the one or more computer readable storage media for execution by at least one of the one or more computer processors, the program instructions comprising:

program instructions to receive, by a user device of a first user, identification data comprising a universally unique identifier (UUID) that is associated with a security database of a second user and a first security token associated with the second user;

program instructions to verify, by the user device, the received identification data by utilizing the UUID to access the security database that purportedly issued the UUID and verifying that the first security token matches a second security token generated by the security database;

responsive to verifying the received identification data, disarming a security system associated with the user device for a specified time period;

program instructions to, responsive to verifying the received identification data, disarm a security system associated with the user device for a specified time period;

program instructions to detect the presence or absence of the second user;

program instructions to confirm whether the second user has completed a task associated with the first security token; and program instructions to, responsive to detecting the absence of the second user and confirming whether the second user has completed the task, automatically re-arm the security system associated with the user device after the specified time period expires.

16. The computer system of claim 15, wherein the first security token is used to authenticate access for the second user to premises associated with the first user.

17. The computer system of claim 16, wherein the first security token comprises: an alphanumeric sequence, an amount of time that the first security token is valid, an amount of authorized time to be on premises, and a stated purpose for access.

* * * * *